US008603802B2

(12) United States Patent
Sung et al.

(10) Patent No.: US 8,603,802 B2
(45) Date of Patent: Dec. 10, 2013

(54) ENZYMATIC PREPARATION OF PLANT FIBERS

(75) Inventors: Wing L. Sung, Ottawa (CA); Mark Wood, Ottawa (CA); Fang Huang, Ottawa (CA)

(73) Assignee: National Research Council of Canada, Ottawa, Ontario (CA)

( * ) Notice: Subject to any disclaimer, the term of this patent is extended or adjusted under 35 U.S.C. 154(b) by 0 days.

(21) Appl. No.: 13/144,470

(22) PCT Filed: Dec. 23, 2009

(86) PCT No.: PCT/CA2009/001886

§ 371 (c)(1),
(2), (4) Date: Jul. 13, 2011

(87) PCT Pub. No.: WO2010/081213

PCT Pub. Date: Jul. 22, 2010

(65) Prior Publication Data

US 2011/0312066 A1 Dec. 22, 2011

Related U.S. Application Data

(60) Provisional application No. 61/193,967, filed on Jan. 13, 2009.

(51) Int. Cl.

| | |
|---|---|
| ***D21C 1/00*** | (2006.01) |
| ***D01C 1/04*** | (2006.01) |
| ***C12Q 1/37*** | (2006.01) |

(52) U.S. Cl.
USPC ..... 435/277; 435/279; 435/23

(58) Field of Classification Search
USPC ..... 435/23, 277, 279
See application file for complete search history.

(56) References Cited

U.S. PATENT DOCUMENTS

| | | | | |
|---|---|---|---|---|
| 3,954,401 | A | 5/1976 | Kling et al. | |
| 4,481,355 | A | 11/1984 | Jaskowski | |
| 4,568,739 | A | 2/1986 | Jaskowski | |
| 4,617,383 | A | 10/1986 | Jaskowski | |
| 4,891,096 | A | 1/1990 | Akkawi | |
| 5,374,555 | A | 12/1994 | Pokora et al. | |
| 5,510,055 | A | 4/1996 | Raimann | |
| 2003/0119172 | A1* | 6/2003 | Hsieh et al. | 435/263 |
| 2009/0311931 | A1 | 12/2009 | Miettinen-Oinonen et al. | |

FOREIGN PATENT DOCUMENTS

| | | |
|---|---|---|
| CA | 2654599 | 12/2007 |
| JP | 5526267 | 2/1980 |
| WO | 03006722 | 1/2003 |
| WO | 2007140578 | 12/2007 |

OTHER PUBLICATIONS

Hsieh et al. Proteases as Scouring Agents; Textile Research Journal, vol. 69, No. 8 (1999) pp. 590-597.*

Effects of Acidic Media Pre-incubation on Flax Enzyme Retting Efficiency by Jing Zhang, Gunnar Johansson, et al., Textile Research Journal on Mar. 1, 2003.

Biochemical Study and Technical Application of Fungal Pectinase by Jing Zhang, Digital Comprehensive Summaries up Uppsala Dissertations from the Faculty of Science and Technology 137, 2006.

Ramie (Boehmeria nivea) by Dr. D.P. Singh, Central Research Institute for Jute & Allied Fibres, undated.

Preparation of Enzymatically Modified Flax Fibre for Producing of Rotor-Spun Yarn for Apparel by Natalia Sedelnik, Stanislaw Zareba and Jerzy Szporek, Fibres & Textiles in Eastern Europe, Jan./Mar. 2006, vol. 14, No. 1.

Properties of Hemp Fibre Cottonized by Biological Modification of Hemp Hackling Noils by Natalia Sedelnik, Fibres & Textiles in Eastern Europe, Jan./Mar. 2004, vol. 12, No. 1.

Morphology and Structure of Hemp Fibre after Bioscouring by Siriart Ouajai and Robert A. Shanks, Macromolecular Bioscience, 2005.

Steeping Maize in the Presence of Multiple Enzymes by J.D. Steinke and L.A. Johnson, Cereal Chemistry, vol. 68, No. 1, 1991.

Bioscouring of Cotton Fabrics by Anita K. Losonczi, Budapest University of Technology and Economics Department of Plastics and Rubber Technology, 2004.

Anaerobic-aerobic Treatment of Toxic Pulping Black Liquor with Upfront Effluent Recirculation by Sjon Kortekaas, Gladys Vidal, He Yan-Ling, Gatze Lettinga and Jim A. Field, Journal of Fermentation and Bioengineering, vol. 86, No. 1, 97-110, 1998.

Scouring of Cotton with Cellulases, Pectinases and Proteases by Emre Karapinar and Merih Ones Sariisik, Fibres & Textiles in Eastern Europe, Jul./Oct. 2004, vol. 12, No. 3.

Fibres from Semi-retted Hemp Bundles by Steam Explosion Treatment by C. Garcia-Jaldon, D. Dupeyre and M.R. Vignon, Biomass and Bioenergy, vol. 14, No. 3, pp. 251-260, 1998.

Degradation of Carrot (Daucus carota) Fibres with Cell-Wall Polysaccharide-Degrading Enzymes by Patrice Massiot, Jean-Francois Thibault and Xavier Rouau, J Sci Food Agric 1989, 49, 45-57.

Chelating Agents and Enzyme Retting of Flax by Anders Peter S. Adamsen, Danny E. Akin and Luanne L. Rigsby, Textile Research Journal, Apr. 1, 2002.

Chemical Retting of Flax Straw Under Alkaline Conditions by Anders Peter S. Adamsen, Danny E. Akin and Luanne L. Rigsby, Textile Research Journal, Sep. 1, 2002.

Nitrogen-removal with protease as a method to improve the selective delignification of hemp stemwood by the whit-rot fungus Bjerkandera sp. strain BOS55 by J. Dorado, J.A. Field, G. Almendros and R. Sierra-Alvarez, Appl Microbiol Biotechnol, 2001.

International Search Reporting, Written Opinion, and IPRP on PCT/CA2009/001886.

* cited by examiner

*Primary Examiner* — Susan Hanley
*Assistant Examiner* — Paul Martin
(74) *Attorney, Agent, or Firm* — Klarquist Sparkman, LLP

(57) ABSTRACT

A method of extracting fibers from decorticated plant bast skin involves pre-treating decorticated plant bast skin of a fiber plant with an aqueous solution containing trisodium citrate having a pH in a range of about 8-14 at a temperature of about 90° C. or less; and subsequently treating recovered fibers with a protease at alkaline pH.

19 Claims, No Drawings

ENZYMATIC PREPARATION OF PLANT FIBERS

CROSS-REFERENCE TO RELATED APPLICATIONS

This application claims the benefit of U.S. Provisional Patent Application Ser. No. 61/193,967 filed Jan. 13, 2009, the entire contents of which is herein incorporated by reference.

FIELD OF THE INVENTION

The present invention relates to processes for preparing plant fibers.

BACKGROUND OF THE INVENTION

Historically, hemp fibers have been used in the textile industry. However, recent breakthroughs in composite materials allowed renewable fibers, for example those from hemp, to replace glass fibers as strengtheners in composite materials. Therefore, the development of procedures to extract hemp fibers without damaging their integrity will facilitate their use in both the textile industry and in biocomposites. Such procedures would preferably be energy-efficient and would avoid the use of hazardous and/or non-biodegradable agents.

In the stem of fiber plants, such as hemp, flax and jute, a bark-like layer containing bast fibers surrounds a woody core or the stemwood. Decortication, either manually or mechanically, is a process that can divide the hemp stem into a hemp "bark" and a hemp "stem wood" fraction. The "stem wood" fraction can be utilized for chemical pulping. (Kortekaas 1998). "Bark" is used to describe all the outer tissues of the stem, including the bast fibers. The bast fibers or fiber bundles are surrounded by pectin or other gumming materials.

Plant fibers, are made of polysaccharides, mainly cellulose. This is different from animal fibers such as silks from silkworm and spiders, wool from sheep or other furry livestock, that are made of protein.

Isolation of plant fiber from the decorticated bark is required before any industrial application. Extraction primarily involves degumming, a removal of pectin from the fiber. Pectin is a polysaccharide which is a polymer of galacturonic acid. Pectin is not soluble in water or acid. However, it can be removed by strong alkaline solutions like caustic soda (concentrated sodium hydroxide).

General methods for isolation of clean fibers include dew retting, water retting, and chemical and enzymatic processes, with various modification. It involves the loosening or removal of the glue that holds the fibers together. The traditional methods are water- or dew-retting. In dew retting, stalks are allowed them to lie in the field after cutting. In some areas of the world, hemp is water-retted by placing bundles of stalks in ponds or streams. These two retting (limited rotting) methods depend on digestion of pectin by enzymes secreted by natural microbes. The water retting process has the disadvantage of polluting the waterway or streams. The dew-retting requires two to six weeks or more to complete, and very much affected by the weather with no guaranty of favorable conditions.

Enzyme retting involves the action of the enzyme pectinase with or without other enzymes like xylanase and/or cellulase. However, the practical application of such enzymes for isolation of hemp fiber remains in experimental stage.

Today the common industrial procedure is chemical retting which involves violent, hazardous chemicals like soda ash, caustic soda and oxalic acid, often at high temperature of 160° C. at pressures of several atmospheres.

Various retting processes are known in the art. Clarke et al. (Clarke 2002) describes a process of removing pectin or gummy materials from decorticated bast skin to yield individual fibers by placement of the bast skin (with or without soaking in an enzyme solution in a pretreatment process) into a closed gas-impermeable container such as plastic bag. The enzyme-producing microbes natural to the bast skin, will thrive on the initial nutrients released by the enzyme pretreatment and will finish the retting process in this closed environment. Clarke also describes an alternative pre-treatment process involving chemicals instead of enzymes, and this includes caustic soda, soda ash, sodium silicate, oxalic acid and ethylenediaminetetraacetic acid (EDTA).

Thus, there is a need for a milder and efficient process for isolating hemp fibers that involves environmentally-friendly and/or biodegradable agents. There is also a question of whether pectin being the only target for degumming. The removal of gumming matters other than the primary target, pectin, may offer the opportunity to yield finer and softer fibers of hemp.

Sung et al. (Sung 2007) taught that pre-treatment of the decorticated hemp bast skin with an aqueous solution containing di-sodium citrate, trisodium citrate or a mixture thereof having a pH of from about 6-13 at a temperature of about 90° C. or less, facilitates the subsequent extraction of fiber with the enzyme pectinase.

The hemp stem consists of both bast fiber (bark) and woody core (stemwood). The major components of these two parts are cellulose, hemicellulose, pectin and lignin (see Table 1) (Garcia-Jaldon 1998).

TABLE 1

Chemical analysis of hemp parts

| | Bast fiber (%) | Woody core (%) |
|---|---|---|
| Cellulose | 55 | 48 |
| Hemicellulose | 16 | 12 |
| Pectin | 18 | 6 |
| Lignin | 4 | 28 |
| Wax + Fat | 1 | 1 |
| Ash | 4 | 2 |
| Protein | 2 | 3 |

In terms of chemical composition, the major differences between the bast fiber (bark) and the woody core (stemwood) are the amount of pectin (18% vs. 6%) and lignin (4% vs. 28%). The large amount of lignin in "stemwood" gives it rigidity. In the case of bast fiber (bark), the lack of lignin is compensated by pectin to glue the individual long fibers and fiber bundles together. Therefor, most research into the liberation of the long fiber from bark has been focused on hydrolysis of pectin, the major gumming component, through the application of the enzyme pectinase.

In comparison, the amount of protein is very small in the bast fiber (2% in bast fiber, Table 1). However, part of this seemingly unimportant protein is structural proteins like "extensin", responsible for the protein matrix which contributes to the structural integrity of the plant itself. Application of protease to the bark may degrade the protein matrix, resulting in the release of non-fiber material or debris physically or chemically associated to the plant protein. As a result of such treatment, fiber may be released or separated.

Pokora et al. taught delignification of refiner mechanical wood pulps to facilitate biopulping, by use of protease at acidic pH (Pokora 1994). Pokora et al. taught that the proteases were used to delignify the wood by the wood protein "extensin". "Extensin" is a cross-linked protein which is suspected of being bound to lignin and functions as a supporting skeleton on a cellular level. Since Pokora et al. is directed to the removal of lignin in mechanical wood pulps, it is not relevant to the isolation of the long fiber from "bark" which contains little lignin (Table 1).

Dorado et al. have taught the use of protease at neutral pH to remove lignin specifically from hemp "stemwood" through a pretreatment with protease (Dorado 2001). Similarly this is not relevant to the extraction of long fiber from bark.

Protease is commonly used in the purification of natural fibers of animal origins, like wool and silk. These fibers are also of protein origin, thus fundamentally different from the plant fibers which are of polysaccharides.

Protease has also been applied in the "bioscouring" of cotton fibers which has various layers of non-cellulosic materials including protein/nitrogenous substances. Cotton when harvested is "cotton boll", which is a soft fluffy ball of already separated individual fibers. The removal of non-cellulosic materials from the surface of individual cotton fibers enhances wettability and ease of dyeing (Karapinar 2004). This is not for application in the separation or extraction of fiber from bark or bast skin of fiber plants. Bark or bast skin of fiber plants such as hemp or flax bark is quite different from cotton boll. Bark or bast skin is a sheet containing individual fibers all glued (or gummed) together into bundle, and then into a sheet. No individual fiber is visible at this stage. Although protein makes a small part of fiber plants, structural proteins like "extensin" interlock separated microfibrils (fine fibers) to reinforce the architecture. Other proteins may also be inserted to cross-link extensin, forming a network between fibers.

Instead of application of a single enzyme, purification of plant fibers may be done with commercial liquid enzyme mixtures produced directly through the culture of the fungus *Aspergillus niger*, including Novo SP249 (Akkawi 1990), or Pektopol PT-400 (Pektowin, Poland) (Sedelnik 2004; Sedelnik 2006). The decorticated fiber bark has to be treated with a bath containing this fungal enzyme mixture for as long as 24 to 36 hr. As expected, these natural enzyme mixtures obtained via culture of *Aspergillus* contain a wide-spectrum of its normal enzymes, including polygalacturonase, pectinase, cellulases, beta-glucanase, hemicellulases, xylanases, arabinase and protease in various amounts (Massiot 1989; Steinke 1991).

The abovementioned commercial enzyme mixtures (Novo SP249 and Pektopol), produced directly through the culture of fungus *Aspergillus*, are only suitable for application at acid pH with optimal pH range of 4-6 (Akkawi 1990; Sedelnik 2006; Steinke 1991). Towards neutral pH, the *Aspergillus* enzymes lose activity rapidly.

As to the effect of long treatment time on plant fiber at acidic (low) pH, Jaskowski (Jaskowski 1984) teaches that acidic treatment solutions at pH below 4.5 can promote acidic hydrolysis of plant fiber, which is primarily cellulose, and that significant degradation of decorticated bast fiber happens if the fiber remains in such treatment solutions for longer than 1 hr. Since treatment with fungal enzyme mixtures as described above lasts 24 hr or longer, damage to the integrity of the purified fiber is a matter of concern.

SUMMARY OF THE INVENTION

It has now been found that treatment of decorticated plant bast skin of a fiber plant with a protease at alkaline pH, after the bast skin has been chemically pre-treated under mild conditions, results in efficient and effective extraction of fibers from the plant bast skin despite the relatively low protein content of fiber plants. This advantageously permits conducting the enzymatic treatment step at non-acidic pH which reduces damage caused by acid hydrolysis of the plant fibers.

Thus, there is provided a method of extracting fibers from decorticated plant bast skin comprising: pre-treating decorticated plant bast skin of a fiber plant with an aqueous solution containing trisodium citrate having a pH in a range of about 8-14 at a temperature of about 90° C. or less; and subsequently treating recovered fibers with a protease at alkaline pH.

In the pre-treatment, an aqueous solution containing trisodium citrate alone has a pH of about 9. The concentration of trisodium citrate is preferably in a range of from about 0.4% (w/v) to about 1.6% (w/v), based on total volume of the aqueous solution. If desired, the pH can be elevated by addition of a stronger base. Preferably, the stronger base is an aqueous solution of sodium hydroxide, preferably having a concentration in a range of from about 0.01% (w/v) to about 5% (w/v), more preferably about 0.1% (w/v) to about 0.5% (w/v), based on total volume of the aqueous solution. If desired, the pH can be lowered to as low as 8 by addition of acid. Preferably, the acid is an aqueous solution of citric acid, preferably having a concentration of about 0.5% (w/v) based on total volume of the aqueous solution.

In the pre-treatment, the temperature of the aqueous solution is about 90° C. or less, preferably in a range of from about 65° C. to about 90° C., for example, in a range of from about 65° C. to about 85° C. Pre-treatment is preferably conducted for a time in a range of about 0.5-12 hours, for example 0.5-5 hours.

If desired, pre-treatment of the fibers may occur in more than one stage, a first stage in which the fibers are treated with trisodium citrate without the addition of a stronger base, followed by one or more further stages in which the fibers are treated with trisodium citrate with the addition of a stronger base (e.g. sodium hydroxide, potassium hydroxide, etc.) to adjust the pH, preferably to a pH in a range of from 10-14. Concentrations of the trisodium citrate and the stronger base in the further stages are as described above. Temperature conditions of the further stages are as described above. The first stage is preferably conducted for about 0.5-2 hours, more preferably 0.5-1 hour, and the second stage preferably for about 0.5-4 hours, for example 0.5-2 hours. Advantageously, the first stage increases extraction efficiency of further stages. If desired, the fibers may be washed with water between stages.

For the preparation of fiber prior to enzyme treatment, with flax fiber, a single-stage pretreatment with trisodium citrate is adequate. With hemp fiber, a 2-stage pretreatment with trisodium citrate initially, followed by sodium hydroxide and trisodium citrate, is preferred.

Pre-treatment as described above, whether done in one stage or more than one stage, is advantageously performed without the presence of enzymes. As a result of pre-treatment, subsequent enzymatic treatment is more efficient and/or may be performed under milder conditions. Advantageously, pre-treatment as described herein permits practical, industrially applicable enzymatic treatment of fiber plant fibers under mild, environmentally friendly conditions.

Plant fibers recovered from pre-treatment are preferably rinsed with water before enzymatic treatment with protease. Enzymatic treatment of recovered fibers employs one or more proteases, preferably from animal or bacterial sources. A preferred source of protease is *Bacillus* microorganisms.

Preferably, the protease is subtilisin, thermolysis, ALCALASE™ or ESPERASE™, all of which can function optimally at alkaline pH. The protease may be natural or modified (e.g. mutant or recombinant). A particularly preferred protease is natural or modified subtilisin. Preferably, the protease is used in an amount of at least 0.24 units of enzyme per gram of fiber treated. An amount in a range of from 0.24-24 units of enzyme per gram of fiber treated is particularly suitable. An amount in a range of from 0.24-4.8 units of enzyme per gram of fiber treated, or even 0.24-2.4 units of enzyme per gram of fiber treated may be successfully used. A unit of the protease is defined as the amount of the protease capable of hydrolyzing casein to produce a color equivalent to 1.0 μmole (181 μg) of tyrosine per min at pH 7.5 at 37° C. (color by Folin-Ciocalteu reagent).

The use of proteases advantageously permits performing enzymatic treatment at an alkaline pH. Preferably, enzymatic treatment is performed in an aqueous medium at a pH of from about 8-12. More preferably, the pH is from about 8-10, even more preferably from about 8.0-9.5. Preferably, the temperature at which enzymatic treatment is performed is in a range of from about 35° C. to 65° C., more preferably in a range of from about 40° C. to 65° C. Preferably, the aqueous medium contains salts and/or buffers, for example trisodium citrate. Concentration of any salts or buffers should not be too high as to unduly affect activity of the enzyme. For example, the concentration of trisodium citrate may be in a range of about 3-7 mM, e.g. 5 mM.

Preferably, enzymatic treatment of the fibers is performed for a period of time in a range of from about 0.5-12 hours, for example about 1-12 hours, more preferably about 0.5-3 hours, even more preferably about 1-3 hours. Stirring or agitation of the aqueous medium may be done. Preferably, the aqueous medium is stirred or agitated every 15 min during enzymatic treatment. Purified fibers after enzymatic treatment may be rinsed with water.

Advantageously, treatment with protease allows hydrolysis of plant proteins, such as the structural proteins. Proteolytic degradation would further release debris physically or chemically associated with these proteins. Surprisingly, although protein constitutes a very small part of fiber plants, the deconstruction of protein-based structural elements in the bark facilitates release of fibers. In a particularly preferred embodiment, enzymatic treatment with protease does not include simultaneous treatment with one or more other enzymes. In such an embodiment, mixtures of enzymes are not used because the protease is used alone in purified form. Protease specifically hydrolyzes proteins on or in-between fibers. Enzyme mixtures described in the prior art (e.g. Novozyme Pectinase Ultra SP-L™) also contain other enzyme components like pectinases, cellulases, xylanases, glucanase and hemicellulases. These other enzymes can attack the fundamental components of fiber, for example cellulose, xylan and hemicellulose, during treatment.

If desired, the purified fibers may be subjected to a subsequent treatment with another enzyme, for example, a pectinase.

Pre-treatment with trisodium citrate and/or sodium hydroxide advantageously permits recycling of enzymes in the extraction of the fibers. For example, used enzyme solutions can be reused for other batches of fiber up to 4 times, or even more in some cases.

Purified fibers from enzyme treatment may be subjected to other treatments, for example bleaching, dyeing, etc., for its eventual application.

Fiber plants include, for example, hemp and flax.

In one particularly preferred embodiment, there is provided a method of extracting fibers from decorticated plant bast skin comprising: pre-treating decorticated plant bast skin of a fiber plant with an aqueous solution containing trisodium citrate having a pH in a range of about 8.5-9.5 at a temperature of about 90° C. or less for about 30-60 minutes; then treating the fibers with a sodium hydroxide solution at a temperature of about 90° C. or less for about 30-120 minutes; and, then treating the fibers with a protease at a temperature in a range of about 40-65° C. at a pH in a range of about 8-10 for about 0.5-12 hours to remove both insoluble debris and soluble materials from the fibers. This embodiment is particularly useful for decorticated hemp bast skin.

In another particularly preferred embodiment, there is provided a method of extracting fibers from decorticated plant bast skin comprising: pre-treating the decorticated plant bast skin of a fiber plant with an aqueous solution containing trisodium citrate having a pH of from about 8.5-9.5 at a temperature of about 90° C. or less for about 30-60 minutes; and, then treating the fibers with a protease at a temperature in a range of about 40-65° C. at a pH in a range of about 8-10 for about 0.5-12 hours to remove both insoluble debris and soluble materials from the fibers. This embodiment is particularly useful for decorticated flax bast skin.

Further features of the invention will be described or will become apparent in the course of the following detailed description.

DESCRIPTION OF PREFERRED EMBODIMENTS

Example 1

Treatment of Hemp Fiber from Decorticated Bast Skin of Full-Grown Hemp, with Protease at Different Concentrations Steps 1 and 2: Pre-Treatment of Hemp Bast Skin (or Bark) Prior to Protease Treatment Twelve grams of decorticated hemp bast skin was pretreated by agitation in 360 ml (3.3% consistency) of an aqueous solution containing 0.4% (w/v) of trisodium citrate at 85° C. for 1 hr. The solution was discarded. This was followed by agitation of the fiber in 360 ml of an aqueous solution containing 0.5% NaOH and 0.4% (w/v) of trisodium citrate at 85° C. for 4 hr. The solution was discarded and the fiber was rinsed by water thrice.

Step 3: Treatment with Protease Subtilisin

The recovered fiber from Step 2, was divided into 6 equal portions, equivalent to 2 gram of the untreated dry fiber. Each portion was suspended in 40 ml (5% consistency) of 0.1% (w/v) of trisodium citrate (pH 9.0) and was treated by one of the four concentrations of the protease (0, 0.2, 0.4 and 0.8 μl/ml), at 55° C. for 3 hr. The protease is subtilisin from *Bacillus licheniformis* (Sigma, 94 mg protein/ml, 12.9 units/mg protein).

Release of total materials, including the insoluble debris, into each of the solutions was monitored via O.D. measured by UV-Vis spectroscopy at 280 nm (Table 2). After centrifugation to remove the debris, the O.D. of the clear supernatant was again determined at 280 nm (Table 3). Aliquots (1 ml) were removed for O.D. measurements at 1, 2 and 3 hours.

In Table 2, without protease (0 μl/ml), the buffer steadily released materials from hemp fiber, including both debris and soluble substances, represented by the $OD_{280}$ of the supernatant as 0.855, 1.041 and 1.269 in 1, 2 and 3 hr respectively. However, with addition of protease at different concentration of 0.05, 0.1 and 0.2 μl/ml, there was a consistent increase in the rate of release of materials ($OD_{280}$) in the supernatants in the same periods. As comparison, with protease at 0.2 μl/ml, the $OD_{280}$ of the supernatant as 1.540, 1.842 and 2.018 in 1, 2 and 3 hr respectively. Such increase of $OD_{280}$ of the supernatant cannot be accounted by the insignificant background $OD_{280}$ (0.087) of protease, which is 0.084 at that concentration. It is obvious that protease expedited the release of both debris and soluble materials from fiber.

The higher concentrations of 0.4 and 0.8 μl/ml did not seem to speed up the release significantly, compared to 0.2 μl/ml.

TABLE 2

O.D. of the raw supernatant with debris from Chinese hemp fiber treated at different concentrations of protease

| Concentration of protease | $OD_{280}$ at different reaction times[1] | | |
|---|---|---|---|
| (μl/ml) | 1 hr | 2 hr | 3 hr |
| 0 | 0.855 | 1.041 | 1.269 |
| 0.05 | 1.273 | 1.538 | 1.801 |
| 0.1 | 1.411 | 1.613 | 1.832 |
| 0.2 | 1.540 | 1.842 | 2.018 |
| 0.4 | 1.599 | 1.912 | 2.118 |
| 0.8 | 1.700 | 1.978 | 2.156 |

[1]$OD_{280}$ of the background created by protease at highest concentration of 0.8 μl/ml is about 0.29, and less than 0.084 at concentration of 0.2 μl/ml.

After the removal of the debris via centrifugation, the OD of the same solutions was re-determined to show only the release of soluble substances detected at 280 nm. In Table 3, without protease (0 μl/ml), the release of soluble materials by buffer was represented by increase of $OD_{280}$ of the supernatant (0.443, 0.607 and 0.710) in 1, 2 and 3 hr respectively. The addition of protease at the concentrations of 0.05, 0.1 and 0.2 μl/ml, also resulted in faster rates of release of the soluble materials in the same periods. It therefore indicated that protease has expedited the release of soluble materials from fiber.

The higher concentrations of 0.4 and 0.8 μl/ml did not seem to speed up the release significantly, compared to 0.2 μl/ml.

TABLE 3

O.D. of the centrifuged clear supernatant from Chinese hemp fiber treated at different concentrations of protease

| Concentration of protease | $OD_{280}$ at different reaction times[1] | | |
|---|---|---|---|
| (μl/ml) | 1 hr | 2 hr | 3 hr |
| 0 | 0.443 | 0.607 | 0.710 |
| 0.05 | 0.845 | 1.029 | 1.178 |
| 0.1 | 0.852 | 1.049 | 1.186 |
| 0.2 | 1.025 | 1.194 | 1.312 |
| 0.4 | 1.131 | 1.306 | 1.421 |
| 0.8 | 1.264 | 1.380 | 1.478 |

[1]$OD_{280}$ of the clear supernatants from Table 2 at different reaction times was determined after removal of the debris via centrifugation.

Based on Tables 2 and 3, it is evident that protease can expedite the release of both the debris and soluble substance from the treated fiber. Significant release can be accomplished in 1 hr at a concentration of protease at 0.2 μl/ml.

Generally O.D. at 280 nm is used to determine the presence of aromatic ring-containing compounds that include substances like lignin or plant protein with aromatic amino acid residues. Since the release of the soluble substances was effected by protease, the target substrate in the hemp fiber would be plant proteins. The present protease treatment of the hemp fiber has likely released short soluble peptides and other substances physically or chemically associated.

The present protease treatment of decorticated bark at alkaline pH is therefore different from that by the *Aspergillus* enzyme mixture at acidic pH described in various prior art.

Step 4: Pectinase Treatment

After the protease step, the supernatant was discarded and the fiber was rinsed by water thrice. The recovered fiber (equivalent to 2 g of the starting dry bast fiber) was treated in 40 ml (5% consistency) of an aqueous solution containing the enzyme pectinase (Novozyme Pectinase (polygalacturonase) from *Aspergillus niger*) at 0.2 μl/ml in 50 mM sodium citrate (pH 5) at 55° C. After 0.5 hr, the enzyme solution could be recovered for recycling. The fiber was rinsed twice with water.

Step 5: Bleaching

The fiber from Step 4 was bleached in 20 ml (5% consistency) of a solution of 0.35% $H_2O_2$ and 0.2% NaOH, 70° C. for 1 hour. The bleaching solution was discarded and the fiber was washed with water thrice. Comparison of the different fiber samples indicated those processed with protease at concentration of 0.1 μl/ml or higher in Step 2, were more separated into finer, softer and brighter fibers than the control sample without protease treatment.

Example 2

Treatment of Hemp Fiber from Decorticated Bast Skin of Full-Grown Hemp, with Protease at Different Temperatures and pH Determination of the Optimal Temperature on the Protease Treatment of Hemp Fiber Bast fiber was pre-treated as described in Steps 1 and 2 of Example 1. Then the pre-treated fiber (equivalent to 1 g of the dry starting bast fiber) was treated with *Bacillus licheniformis* protease subtilisin (0.2 μl/ml) in 20 ml (5% consistency) of 0.1% (w/v) of trisodium citrate (pH 9.4), at 55 and 65° C. for 3 hr.

Release of soluble materials, free of the debris, into each of the solutions was monitored via O.D. measured by UV-Vis spectroscopy at 280 nm (Table 4). After centrifugation to remove the debris, the O.D. of the clear supernatant was again determined at 280 nm (Table 4). Aliquots (1 ml) were removed for O.D. measurement at 1, 2 and 3 hours.

TABLE 4

Effect of temperature on the centrifuged clear supernatant from Chinese hemp fiber treated by protease at different temperatures

| | $OD_{280}$ at different reaction times | | |
|---|---|---|---|
| Temperature (° C.) | 1 hr | 2 hr | 3 hr |
| 55 (Buffer) | 0.603 | 0.726 | 0.834 |
| 55 | 1.001 | 1.193 | 1.312 |
| 65 | 0.945 | 1.223 | 1.324 |

In Table 4, the supernatants with protease (55° C. and 65° C.) have much higher OD than the control which is a buffer without protease. There was little difference in the OD between supernatants at 55° C. and 65° C.

Determination of the Optimal pH on the Protease Treatment of Fiber

The fiber samples (equivalent to 1 g of dry starting bast fiber) pretreated by NaOH as described in Step 2 of Example 1, were processed with *Bacillus licheniformis* protease subtilisin (0.2 μl/ml) in 40 ml of 0.1% (w/v) of trisodium citrate at different pH (8.0, 8.5, 9.0 and 9.5) and 55° C. for 3 hr.

Release of soluble materials, free of the debris, into each of the solutions was monitored via O.D. measured by UV-Vis spectroscopy at 280 nm (Table 5). After centrifugation to remove the debris, the O.D. of the clear supernatant was again determined at 280 nm (Table 5).

TABLE 5

O.D. of the centrifuged clear supernatant from Chinese hemp fiber treated by protease at different pH

| | $OD_{280}$ at different reaction times | | |
|---|---|---|---|
| pH | 1 hr | 2 hr | 3 hr |
| 8.0 | 0.561 | 0.663 | 0.728 |
| 8.5 | 0.609 | 0.680 | 0.758 |
| 9.0 | 0.700 | 0.820 | 0.876 |
| 9.5 | 0.534 | 0.660 | 0.710 |

In Table 5, based on the value of $OD_{280}$, it is evident that that the protease subtilisin was efficient at pH 8.0, 8.5, 9.0 and 9.5, but slightly more at 9.0 than the rest. The use of alkaline pH in the present protease treatment is therefore in big contrast to the use of acidic pH of the *Aspergillus* enzyme mixture described in various prior art.

Example 3

Treatment of Hemp Fiber from Decorticated Bast Skin of Young Hemp (70 Days), with Proteases In order to confirm that protease treatment is applicable to other hemp fiber sample, the protocol used in Example 1 was repeated for the processing of the young hemp grown for 70 days in the region of Peace River, Alberta, Canada, including Steps 1 to 5.

In Step 3 involving protease treatment, two samples were treated with or without the protease subtilisin at 0.2 μl/ml. The $OD_{280}$ values of both the raw and the centrifuged supernatants were determined (Table 6). The $OD_{280}$ values of the protease supernatants were consistently higher than the control. It therefore indicated that the protease treatment is effective to release both the debris and the soluble material from the Canadian hemp fiber.

TABLE 6

O.D. of the raw and centrifuged supernatants from Canadian hemp fiber treated with or without protease

| Concentration of protease | $OD_{280}$ of raw supernatant at different reaction times[1] | | | $OD_{280}$ of centrifuged clear supernatants at different reaction times[2] | | |
|---|---|---|---|---|---|---|
| (μl/ml) | 1 hr | 2 hr | 3 hr | 1 hr | 2 hr | 3 hr |
| 0 | 0.381 | 0.338 | 0.350 | 0.186 | 0.242 | 0.312 |
| 0.2 | 0.565 | 0.608 | 0.714 | 0.442 | 0.442 | 0.551 |

[1] $OD_{280}$ of the background created by protease is less than 0.084 at concentration at 0.2 μl/ml.
[2] $OD_{280}$ of the clear supernatants at different reaction times was determined after removal of the debris via centrifugation of the raw solutions.

Example 4

Extraction of Hemp Fiber from Decorticated Bast Skin of the Full-Grown Hemp, without the Use of Pectinase The full-grown hemp bast fiber was also purified by a shorter procedure, as compared to Example 1, including a much shorter pretreatment in NaOH (from 3 hr to 1 hr) and shorter treatment in protease subtilisin (3 hr to 1.5 hr), without the subsequent pectinase treatment as described as Step 4 in Example 1.

Steps 1 and 2: Pre-Treatment of Hemp Bast Skin (or Bark) Prior to the Protease Treatment Decorticated hemp bast skin was pre-treated by agitation in an aqueous solution (3.3% consistency) of containing 0.4% (w/v) of trisodium citrate at 85° C. for 30 min. The solution was discarded and the fiber was rinsed by water thrice. The solution was discarded. This was followed by agitation at 3.3% consistency in an aqueous solution containing 0.5% NaOH and 0.4% (w/v) of trisodium citrate at 85° C. for 1 hr. The solution was discarded. The fiber was sprayed with a waterjet to facilitate the removal of a good amount of plant debris loosely attached to the fiber.

Step 3: Protease Treatment

The pre-treated hemp fiber from Step 2 was suspended at 5% consistency in a solution of 0.1% (w/v) of trisodium citrate (pH 9.0) with or without protease subtilisin at 0.2 μl/ml at 55° C. for 1.5 hr. The solution was discarded and the fiber was washed by water twice. Without the pectinase treatment described in Example 1, the washed fiber was bleached.

Step 4: Bleaching

The hemp fiber from Step 3 of protease treatment was bleached in 20 ml (5% consistency) of a solution of 0.35% $H_2O_2$ and 0.2% NaOH, 70° C. for 1 hour. The bleaching solution was discarded and the fiber was washed with water thrice. This yielded bright, fine and soft fibers comparable to the sample processed with the long protocol described in Example 1.

As the pre-treatment with trisodium citrate/sodium hydroxide proceeded at pH 9-14 and the subsequent protease treatments proceeded at pH 9, all steps in the present purification of fiber were conducted in alkaline pH. This avoided any long exposure of fiber in acidic condition that may damage its integrity.

Example 5

Extraction of Hemp Fiber from Decorticated Bast Skin of the Young Hemp, without the Use of Pectinase The young hemp bast fiber was also purified by a shorter procedure, as compared to Example 1, including a much shorter pretreatment in NaOH (3 hr to 2 hr) at lower temperature (70° C. vs. 85° C.), and shorter treatment in protease subtilisin (3 hr to 1.5 hr), without the subsequent pectinase treatment as described as Step 4 in Example 1.

Steps 1 and 2: Pre-Treatment of Hemp Bast Skin (or Bark) Prior to the Protease Treatment Decorticated hemp bast skin was pre-treated by agitation in an aqueous solution (3.3% consistency) containing 0.4% (w/v) of trisodium citrate at 70° C. for 30 min. The solution was discarded and the fiber was rinsed by water thrice. The solution was discarded. This was followed by agitation at 3.3% consistency in an aqueous solution containing 0.5% NaOH and 0.4% (w/v) of trisodium citrate at 70° C. for 2 hr.

The solution was discarded. The fiber was sprayed with a waterjet to facilitate the removal of any plant debris loosely attached to the fiber.

Step 3: Protease Treatment

The pre-treated hemp fiber from Step 2 was suspended at 5% consistency in a solution of 0.1% (w/v) of trisodium citrate (pH 9.0) with or without protease subtilisin at 0.2 μl/ml at 55° C. for 1.5 hr. The solution was discarded and the fiber was washed by water twice. Without the pectinase treatment described in Example 1, the washed fiber was bleached.

Step 4: Bleaching

The hemp fiber from Step 3 of protease treatment was bleached in 20 ml (5% consistency) of a solution of 0.35% $H_2O_2$ and 0.2% NaOH, 70° C. for 1 hour. The bleaching solution was discarded and the fiber was washed with water thrice. This yielded bright, fine and soft fibers.

Like Example 4, all steps including the pre-treatment with trisodium citrate/sodium hydroxide proceeding at pH 9-14 and the subsequent protease treatment proceeding at pH 9, have been conducted in alkaline pH. This has avoided the long exposure of fiber in acidic condition that may damage its integrity.

Example 6

Treatment of Flax Fiber from Decorticated Bast Skin of Flax, with Protease

Flax fiber was purified by a shorter procedure, as compared to Example 1, including a 1-step pretreatment without NaOH, without subsequent pectinase treatment.

Step 1: Pre-Treatment of Flax Bast Skin (or Bark) Prior to the Protease Treatment Decorticated flax bast skin was pre-treated by agitation in an aqueous solution (5% consistency) containing 0.4% (w/v) of trisodium citrate at 85° C. for 1 hr. The solution was discarded and the fiber was rinsed by water thrice. Without the NaOH pre-treatment described in Step 1 of Example 1, the fiber was treated with the protease subtilisin as described in Step 2 below.

Step 2: Protease Treatment

The pre-treated flax fiber from Step 1 was suspended at 5% consistency in a solution of 0.1% (w/v) of trisodium citrate (pH 9.0) with or without protease subtilisin at 0.2 μl/ml at 55° C. for 3 hr. The release of total materials, including the debris, into each of the solutions was monitored via O.D. measured at 280 nm (Table 7). Aliquots (1 ml) were removed to for the O.D measurement of the raw supernatant and the clear centrifuged supernatant at 1, 2 and 3 hours. It was evident that the protease has accelerated the release of debris and other soluble materials from the flax fiber.

TABLE 7

O.D. of the raw and centrifuged supernatants from flax fiber treated with or without protease

| Concentration of protease | $OD_{280}$ of raw supernatant at different reaction times[1] | | | $OD_{280}$ of centrifuged clear supernatants at different reaction times[2] | | |
|---|---|---|---|---|---|---|
| (μl/ml) | 1 hr | 2 hr | 3 hr | 1 hr | 2 hr | 3 hr |
| 0 | 0.478 | 0.616 | 0.754 | 0.209 | 0.305 | 0.368 |
| 0.2 | 1.507 | 1.861 | 2.380 | 0.925 | 1.204 | 1.452 |

[1]$OD_{280}$ of the background created by protease is less than 0.084 at concentration at 0.2 μl/ml.
[2]$OD_{280}$ of the clear supernatants at different reaction times was determined after removal of the debris via centrifugation of the raw solutions.

Step 3: Bleaching

The flax fiber from Step 2 of protease treatment was washed by water twice. Without the pectinase treatment described in Example 1, the fiber was bleached in 20 ml (5% consistency) of a solution of 0.35% $H_2O_2$ and 0.2% NaOH, 70° C. for 1 hour. The bleaching solution was discarded and the fiber was washed with water thrice. Comparison of the fiber samples indicated those processed with protease was more separated into finer fibers and softer than the control sample without protease treatment.

Both pre-treatment and protease treatment in the present purification of fiber were conducted in alkaline pH. This avoided any long exposure of fiber to an acidic condition that may damage its integrity.

Example 7

Extraction of Hemp Fiber from Retted Bast Skin of Hemp, without the Use of Pectinase Retted hemp bast fiber was also purified by a shorter procedure, as compared to Example 1, including a much shorter pretreatment in NaOH (3 hr to 2.5 hr) at 85° C., and shorter treatment in protease subtilisin (3 hr to 2 hr) at lower concentrations, without the subsequent pectinase treatment as described as Step 4 in Example 1.

Steps 1 and 2: Pre-Treatment of Retted Hemp Bast Skin (or Bark) Prior to the Protease Treatment Retted and decorticated hemp bast skin was pre-treated by agitation in an aqueous solution (3.3% consistency) of containing 0.4% (w/v) of trisodium citrate at 85° C. for 30 min. The solution was discarded and the fiber was rinsed by water thrice. The solution was discarded. This was followed by agitation at 3.3% consistency in an aqueous solution containing 0.5% NaOH and 0.4% (w/v) of trisodium citrate at 85° C. for 2.5 hr. The solution was discarded and the fiber was rinsed by water thrice.

Step 3: Protease Treatment

The pre-treated hemp fiber from Step 2 was suspended at 5% consistency in a solution of 0.1% (w/v) of trisodium citrate (pH 9.0) with protease subtilisin at 0, 0.01, 0.05, 0.1 and 0.2 μl/ml at 55° C. for 2 hr. Release of soluble materials into the solutions of each run was monitored via UV-Vis spectroscopy at 280 nm. Aliquots (1 ml) were removed for O.D. measurement at 0, 0.5, 1, 1.5 and 2 hr. After centrifugation to remove debris, the O.D. of the clear supernatant was determined at 280 nm via UV-Vis spectroscopy (Table 8).

TABLE 8

O.D. of the centrifuged supernatants from hemp fiber treated with protease at different concentrations

| | $OD_{280}$ of centrifuged clear supernatants at different reaction times Concentration of protease (μl/ml) | | | | |
|---|---|---|---|---|---|
| Time (hr) | 0* | 0.01 | 0.05 | 0.1 | 0.2 |
| 0 | 0.203 | 0.170 | 0.182 | 0.186 | 0.208 |
| 0.5 | 0.321 | 0.373 | 0.418 | 0.461 | 0.451 |
| 1.0 | 0.348 | 0.444 | 0.486 | 0.534 | 0.525 |
| 1.5 | 0.371 | 0.490 | 0.523 | 0.589 | 0.576 |
| 2.0 | 0.380 | 0.504 | 0.578 | 0.633 | 0.610 |

*0.1% (w/v) of trisodium citrate (pH 9.0) without protease

After 2 hr, the solution was discarded and the fiber was washed by water twice. Without the pectinase treatment described in Example 1, the washed fiber was bleached.

Step 4: Bleaching

The hemp fiber from Step 3 of protease treatment was bleached in 20 ml (5% consistency) of a solution of 0.35% $H_2O_2$ and 0.2% NaOH, 70° C. for 1 hour. The bleaching solution was discarded and the fiber was washed with water thrice. Fiber samples which were previously treated with the protease at concentration of 0.01 to 0.2 μl/ml in Step 3, yielded bright and soft fine fibers.

Comparison of Protease Treatment to Pectinase Treatment:

Example 4 taken with Example 1 shows that the process involving protease alone results in fibers of better quality than the pectinase process of the prior art (Sung 2007).

In Example 1, the protocol for testing protease has five steps: Steps 1 & 2 of pretreatment, Step 3 of protease, Step 4 of pectinase and Step 5 of Bleaching. In Example 1, there is also a parallel control run without Step 3 of protease, which is equivalent to the "pectinase process" of Sung et al (Sung 2007). The control run is of four steps: Steps 1 & 2 of pretreatment, Step 3 of pectinase and Step 4 of bleaching. In Table 2, the control run is represented by the run with concentration of protease at 0 μl/ml. As indicated in Example 1, comparison of the different fiber samples indicated those processed with protease at concentration of 0.1 μl/ml or higher in Step 2, were more separated into finer, softer and brighter fibers than the control sample without protease treatment. Therefore Example 1 teaches that with both protease and pectinase treatment, the fiber is better than with pectinase treatment alone.

Further, Example 4 describes a protocol with four steps, i.e. to eliminate the pectinase step. Therefore there are four steps: Steps 1 & 2 of pretreatment, Step 3 of protease and Step 4 of bleaching. In this protocol, there is only protease treatment without pectinase treatment. As described in Example 4, this process (i.e. protease alone) yielded bright, fine and soft fibers comparable to the sample processed with the long protocol (i.e. protease plus pectinase) described in Example 1. Therefore, Example 4 teaches that the protease alone process is comparable to the protease/pectinase process.

Since Example 1 demonstrates that the long protocol with both protease and pectinase is better than pectinase alone, and Example 4 demonstrates that the protease alone process is comparable to the protease/pectinase process, it is evident that the protease alone process provides improved results over pectinase alone. Therefore the instant protease process is better than the pectinase process of the prior art.

REFERENCES

Adamsen A P S, Akin D E, Rigsby L L (2002) *Textile Res. J.* 72: 789-794.

Adamsen A P S, Akin D E, Rigsby L L (2002) *Textile Res. J.* 72: 296-302.

Akkawi J-S (1990) U.S. Pat. No. 4,891,096 issued Jan. 2, 1990.

Chiyouzou H (1980) Espacenet patent abstract of JP 55026267 published Feb. 25, 1980.

Clarke A F, Dennis H G S, Wang X, Hurren C J (2002) PCT international patent publication WO 03/006722 published on Jan. 23, 2003.

Dorado J, Field J A, Almendros G, Sierra-Alvarez R (2001) *Appl. Microbiol. Biotechnol.* 57: 205-211.

Garcia-Jaldon C, Dupeyre D, Vignon M R (1998) *Biomass and Bioenergy.* 14: 251-260.

Jaskowski M C (1984) U.S. Pat. No. 4,481,355 issued Nov. 6, 1984.

Jaskowski M C (1986a) U.S. Pat. No. 4,568,739 issued Feb. 4, 1986.

Jaskowski M C (1986b) U.S. Pat. No. 4,617,383 issued Oct. 14, 1986.

Karapinar E, Sariisik, M O (2004) *Fiber & Textile in Eastern Europe.* 12: 79-82.

Kling A, Specht V (1976) U.S. Pat. No. 3,954,401 issued May 4, 1976.

Kortekaas S, Vidal G, Yan-Ling H, Lettinga G, Field J A (1998) *J. Fermentation and Bioengineering.* 86: 97-110.

Massiot P, Thibault J-F, Rouau X (1989) *J Sci Food Agri.* 49: 45-57.

Ouajai S, Shanks R A (2005) *Macromol. Biosci.* 5: 124-134.

Pokora A R, Johnson M A (1994) U.S. Pat. No. 5,374,555 issued Dec. 20, 1994.

Raimann W (1986) U.S. Pat. No. 5,510,055 issued Apr. 23, 1996.

Sedelnik N (2004) *Fiber & Textile in Eastern Europe* 12: 58-60.

Sedelnik N, Zareba S, Szporek J (2006) *Fiber & Textile in Eastern Europe* 14: 22-26.

Singh D P (2006) Report of the Central Research Institute for Jute & Allied Fibres, Indian Council of Agricultural Research entitled "Ramie (*Boemmeria nivea*)". Section entitled "Degumming". Extracted from the Internet May, 2006.

Steinke J D, Johnson L A (1991) *Cereal Chem.* 68: 7-12.

Sung W L, Wood M, Huang F (2007) PCT international patent publication WO 2007/1405780 published on Dec. 13, 2007.

Zhang J, Johansson G, Petterson B, Akin D E, Foulk J A, Khalili S, Henriksson G (2003) *Textile Res. J.* 73: 263-267.

Zhang J (2006) Doctoral Thesis Dissertation entitled "Biochemical Study and Technical Applications of Fungal Pectinase". Digital Comprehensive Summaries of Uppsala Dissertations from the Faculty of Science and Technology 137.

Other advantages that are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

The invention claimed is:

1. A method of extracting fibers from decorticated plant bast skin, the method comprising:

pre-treating decorticated plant bast skin of a fiber plant with an aqueous solution containing trisodium citrate having a pH in a range of about 8-14 at a temperature of about 90° C. or less; and subsequently treating recovered fibers with a protease at alkaline pH.

2. The method of claim 1, wherein the pre-treating is performed at a temperature in a range of from about 65° C. to about 90° C.

3. The method of claim 1, wherein the pre-treating is performed at a temperature in a range of from about 65° C. to about 85° C.

4. The method of claim 1, wherein pre-treating is conducted for a time in a range of about 0.5-5 hours.

5. The method of claim 1, wherein treating with protease is performed in an aqueous medium at a pH in a range of about 8-12.

6. The method of claim 1, wherein treating with protease is performed in an aqueous medium at a pH in a range of about 8-10.

7. The method of claim 1, wherein treating with protease is performed in an aqueous medium at a pH in a range of about 8.0-9.5.

8. The method of claim 1, wherein treating with protease is performed at a temperature in a range of about 35-65° C.

9. The method of claim 1, wherein:

the pre-treating is done at a pH in a range of about 8.5-9.5 at a temperature of about 90° C. or less for about 30-60 minutes followed by treating with a sodium hydroxide solution at a temperature of about 90° C. or less for about 30-120 minutes; and treating the recovered fibers with protease is done at a temperature in a range of about 40-65° C. at a pH in a range of about 8-10 for about 0.5-12 hours.

10. The method of claim 9, wherein treating the fibers further comprises treating the fibers with a pectinase in an aqueous solution of sodium citrate at a pH in a range of about 4-6 at a temperature of about 30-45° C. for about 1-12 hours.

11. The method of claim 1, wherein the fiber plant is hemp.

12. The method of claim 1, wherein:

the pre-treating is done at a pH of from about 8.5-9.5 at a temperature of about 90° C. or less for about 30-60 minutes; and treating the recovered fibers with protease is done at a temperature in a range of about 40-65° C. at a pH in a range of about 8-10 for about 0 5-12 hours.

13. The method of claim 1, wherein the fiber plant is flax.

14. The method of claim 1, wherein the protease is of *Bacillus* origin.

15. The method of claim 1, wherein the protease is natural or modified subtilisin or thermolysin.

16. The method of claim 1, wherein the protease is natural or modified subtilisin.

17. The method of claim 1, wherein the protease is used in an amount of at least 0.24 unit of enzyme per gram of fiber treated.

18. The method of claim 17, wherein the amount of protease is in a range of from 0.24-24 units of enzyme per gram of fiber treated.

19. The method of claim 17, wherein the amount of protease is in a range of from 0.24-4.8 units of enzyme per gram of fiber treated.

* * * * *